United States Patent [19]

Haines

[11] Patent Number: 4,846,276

[45] Date of Patent: Jul. 11, 1989

[54] WATER-ALTERNATING-GAS FLOODING OF A HYDROCARBON-BEARING FORMATION

[75] Inventor: Hiemi K. Haines, Englewood, Colo.

[73] Assignee: Marathon Oil Company, Findlay, Ohio

[21] Appl. No.: 240,781

[22] Filed: Sep. 2, 1988

[51] Int. Cl.[4] ..... E21B 43/18; E21B 43/20

[52] U.S. Cl. ..... 166/273; 166/274

[58] Field of Search ..... 166/273, 274, 263, 268

[56] References Cited

U.S. PATENT DOCUMENTS

| | | | |
|---|---|---|---|
| 1,658,305 | 2/1928 | Russell . | |
| 2,609,051 | 9/1952 | Brownscombe | 166/21 |
| 3,134,433 | 5/1964 | Bocquet et al. | 166/273 |
| 3,227,210 | 1/1966 | Trantham | 166/273 X |
| 3,244,228 | 4/1966 | Parrish | 166/9 |
| 3,344,857 | 10/1967 | Gilchrist | 166/273 |
| 3,493,049 | 2/1970 | Matthews et al. | 166/263 |
| 3,525,395 | 8/1970 | Chew | 166/263 |
| 3,525,396 | 8/1970 | Chew | 166/263 |
| 3,882,940 | 5/1975 | Carlin | 166/273 |

OTHER PUBLICATIONS

Pfister, R. J., "More Oil from Spent Water Drives by Intermittent Air or Gas Injection", Producer's Monthly, pp. 10–12, Sep. 1947.

Champion, J. H., et al., "An Immiscible WAG Injection Project in the Kuparuk River Unit", Society of Petroleum Engineers Paper No. SPE 16719, Sep. 1987.

Gorbanetz, V. K., et al., "Effect of Layered Inhomogeneity of the Formation on Oil Displacement by Enriched Gas," Neftyanoe Khozyaistvoe, No. 8, 1975, pp. 36–37.

*Primary Examiner*—Stephen J. Novosad

*Attorney, Agent, or Firm*—Jack L. Hummel; Rodney F. Brown

[57] ABSTRACT

A zone of a subterranean formation containing a low-viscosity crude oil which has already been water-flooded to completion is sequentially flooded with alternating slugs of produced gas and water to produce incremental amounts of the oil. The zone is characterized as a low-permeability zone having mixed geology, i.e., containing two or more rocks of differing permeability randomly distributed throughout the zone.

15 Claims, No Drawings

WATER-ALTERNATING-GAS FLOODING OF A HYDROCARBON-BEARING FORMATION

BACKGROUND OF THE INVENTION

1. Technical Field

The invention relates to a process for recovering hydrocarbons from a subterranean hydrocarbon-bearing formation and more particularly to a process for enhancing the recovery of hydrocarbons from a subterranean hydrocarbon-bearing formation by flooding the formation with fluids.

2. Background Information

It has been speculated that flooding of a subterranean oilbearing sandstone formation with alternating slugs of water and a gas can improve oil recovery from the formation over conventional secondary recovery means, such as waterflooding. See, for example, Pfister, R. J., "More Oil From Spent Water Drives By Intermittent Air or Gas Injection", Producer's Monthly, pp. 10–12, September, 1947, which suggests that water-alternating-gas (WAG) flooding is superior to conventional waterflooding in the sandstone Bradford Field of western Pennsylvania. U.S. Pat. No. 1,658,305 to Russell suggests an oil recovery mechanism for WAG flooding in sandstone formations.

Subsequent to these references, a number of modifications and improvements to the basic WAG process have developed in the art as exemplified by U.S. Pat. Nos. 3,244,228 to Parrish, 3,525,395 and 3,525,396 to Chew, and 3,882,940 to Carlin as well as Champion, J. H., et al, "An Immiscible WAG Injection Project in the Kuparuk River Unit", Society of Petroleum Engineers Paper No. SPE 16719, presented in September 1987. All of these references demonstrate the utility of WAG flooding in homogeneous sandstone formations.

References also exist which disclose the utility of cyclically flooding heterogeneous formations with alternate fluids. Gorbanetz, V. K., et al, "Effect of Layered Inhomogeneity of the Formation on Oil Displacement by Enriched Gas", Neftyanoe Khozyaistvoe, n. 8, 1975, pp. 36–37, WAG floods a heterogeneous formation with an enriched gas under miscible conditions. The heterogeneous formation of Gorbanety et al contains two or more isolated homogeneous oilbearing strata of differing permeabilities.

U. S. Pat. No. 3,493,049 to Matthews et al cyclically floods a heterogeneous formation with water, gas, and an oxidizing agent. The heterogeneous formation of Matthews et al contains fractures, channels, lenses or networks of differing permeability or porosity. Matthews et al is not a true WAG flooding process because in practice it requires pressure pulsing and the injection of a separate oxidizing agent slug in addition to the water and gas slugs.

It is apparent that the art generally recognizes the utility of WAG flooding processes in certain types of formations. However, a number of formations exist other than those described above in which WAG flooding processes are not believed to improve oil recovery. For example, WAG flooding is not believed to be effective in formations where the producing stratum or zone contains a residual light crude oil and comprises two or more rock types of differing permeabilities. Thus, a need exists for a process to effectively recover oil from formations exhibiting these characteristics.

SUMMARY OF THE INVENTION

The present invention is a process for recovering additional oil from an oil-bearing zone of a subterranean formation which has been substantially waterflooded to completion. The oil-bearing zone is characterized as having a mixed geology and containing a light crude oil. The mixed geology of the producing zone is attributed to the presence of two or more rock types of differing geological permeability in the same zone which are randomly distributed throughout the zone.

The process comprises cyclically flooding the formation with an alternating sequence of gas and water via an injection well while simultaneously producing oil from the formation via a production well. The injected gas is preferably a produced natural gas which is injected into the injection well at conditions which render it immiscible in the light crude oil.

A gas injection sequence followed by a water injection sequence constitutes one injection cycle. The injection cycles are repeated indefinitely until no further oil can be economically produced from the formation.

The present process is a tertiary process which enables one to recover significant amounts of residual oil which are unrecoverable by conventional secondary recovery methods. The process unexpectedly improves oil recovery from formations having mixed geology and containing light crude oil. At the same time, the process realizes cost savings by flooding with a produced natural gas at immiscible formation conditions.

DESCRIPTION OF A PREFERRED EMBODIMENT

The present invention is a teritary process for recovering additional amounts of residual oil from a subterranean formation which has been waterflooded to completion. A "tertiary recovery process" is defined herein as an oil recovery process having a mechanism which comprises modifying the properties of the oil in place to facilitate displacement of the oil from the formation.

A "secondary recovery process" is distinguishable from a tertiary process by the mechanism of the secondary process which comprises applying an extrinsic energy source to the formation to facilitate displacement of the oil in place without altering its properties. Thus,-the waterflood which precedes the present tertiary process is a secondary process. By "waterflooded to completion" it is meant that the formation is waterflooded until it reaches its economic limit, i.e., insufficient oil is produced or the water to oil ratio of the produced fluid is too great to offset production operating costs, including the costs of injecting water, separating the produced oil and water, and disposing the produced water.

The present tertiary process comprises continuously producing oil from an oil production well in fluid communication with an oilbearing zone of a formation while simultaneously injecting a finite gas slug into the oilbearing zone via an injection well in fluid communication with this zone. The terms "zone" and "stratum" are synonymous as used herein and are defined as a region within the formation which is bounded by geologic barriers which effectively isolate the region and prevent fluid communication between the region of interest and other regions of the formation. Thus, an oil-bearing zone is a region of a formation containing a single isolated accumulation of hydrocarbons which is characterized by a common pressure system.

Injection of gas into the oil-bearing zone proceeds until oil production at the production well declines to a predetermined level. Gas injection is then terminated and water injection is initiated from an injection well while maintaining the production well in operation. The water injection well may be the same well as the gas injection well or it may be a different well in fluid communication with the oil-bearing zone. In any case, oil is continuously produced from the production well simultaneous with water injection until oil production diminishes to a predetermined level. Water injection is then terminated which completes one injection cycle of the present process.

The injection cycle is repeated as often as desired while continuously producing oil from the production well. When the total oil production for a given cycle diminishes to a predetermined level, the process is terminated. The production level at which the process is terminated is generally the economic limit of the oil-bearing zone.

Although the process is described above in terms of continuous oil production and continuous fluid injection of either gas or water, the present process can also be practiced without deviating from the scope of the invention by interrupting and resuming either fluid injection, oil production, or both at any given time. However, if such interruptions occur, they are performed for purposes other than pressure pulsing the oil-bearing zone. In general, the present process is operated at either a substantially constant pressure or a substantially continuous pressure decline throughout its duration.

The preferred injection gas of the process is a produced gas, i.e., natural gas, which has been produced from the same formation or a different formation from that which is being flooded. The bulk of the injection gas comprises methane. The gas is injected into the formation without having undergone substantial processing or enrichment, although in some cases inorganic components of the produced gas, such as carbon dioxide or hydrogen sulfide, may be reduced or removed for operational purposes to reduce metallurgical corrosion during reinjection.

Produced gas is preferred in the present process because of its ready availability at low cost. however, if produced gas is not readily available alternative gasses may be used including preferably carbon dioxide or less preferably nitrogen.

The gas is injected into the formation at a pressure within a range which is below the formation fracturing pressure and below the minimum miscibility pressure of the injection gas in the oil in place, but is above the bubble point pressure of the oil. The minimum miscibility pressure is defined as the pressure at which the interfacial tension between an oil and a gas approximates zero at their contact point. The actual gas injection pressure is selected within the above-recited range by considering a number of factors including the incremental oil recovery which can be achieved for a given pressure and volume of gas as well as the size and cost required to compress gas to a given pressure.

As stated above, the gas injection pressure is below the minimum miscibility pressure of the gas in the oil. This enables lower cost operation of the process because less gas is required than in a miscible process to displace an equivalent amount of oil. Other advantages include the safer operation, downsizing of the gas compressors and a reduced risk of undesirable formation fracturing.

As also noted above, the gas is injected in a manner which does not substantially raise the formation pressure to a pressure conventionally associated with pressure pulsing. Gas injection generally does not raise the formation pressure more than about 5 percent above the pressure prior to gas injection.

The injection water can be any aqueous liquid. Produced brine or sea water are preferred injection waters because of their availability and low cost as well as low risk of clay damage. It is also possible, although not necessary, to include additives in the injection water, such as surfactants or polymers, to further enhance the ability of the water to displace oil to the production well.

The level of oil recovery is the primary variable which determines the duration and volume of each fluid injection sequence. Generally oil recovery increases when each fluid injection sequence begins. As the injection sequence continues the level of oil recovery peaks and then declines. At some predetermined point on the decline curve, the injection sequence for that particular fluid is terminated and the injection sequence for the alternate fluid begins. The termination point is often a function of the particular formation characteristics and the type of injection and production fluids. In most cases it can be predetermined by experimental or theoretical modelling.

The volumetric ratio of water to gas injected into the formation during a given injection cycle is typically about 1:1 where the gas volume is based on formation conditions. This volumetric ratio of water to gas generally maximizes oil recovery. However, in some cases it may be preferable to inject a smaller volume of gas than water where gas injection is significantly more expensive than water injection. In such cases reduced, but acceptable, levels of oil recovery can be achieved with water to gas injection ratios of up to 4:1 or more. Of course the relative volumes of fluids injected from cycle to cycle can also vary significantly depending on the performance of the injection fluids.

The present process is preferably practiced in a formation which has an oil-bearing zone of mixed geology, i.e., the zone or stratum contains two or more rock types of differing geological characteristics randomly distributed in an unstratified manner through the zone. The operative distinguishing characteristic between the rocks is that one rock should be substantially less permeable to fluids than the other. This permeability difference between the rocks can vary from as little as about 3 or 4 times to as much as about 2000 times or more. The overall average permeability of the oil-bearing zone generally ranges from about 1 to about 2000 millidarcies and preferably about 25 to about 1000 millidarcies.

An example of an oil-bearing zone having the characteristic of mixed geology is a zone containing conglomerate. Conglomerate is defined herein as a material comprising rounded stones and clast randomly distributed within a matrix made up of much smaller rock particles. The stones and clast can be virtually any type of rock and can vary in size from gravel- or pebble-size to as large as cobble- or boulder-size. The matrix is typically a porous rock such as sandstone. Generally, the rock of the matrix has a higher average permeability than the rock of the stones and clast.

The oil in place in the formation is a relatively light oil. By light oil, it is meant that the oil has a relatively low viscosity and a high API gravity at formation conditions. Light oils generally have an API gravity above about 40° API or have a viscosity between about 0.5 and about 20 cp and preferably between about 0.5 and about 5 cp at formation conditions.

The present process effectively reduces the residual oil saturation of the oil-bearing zone of the formation in contrast to other enhanced displacement processes, such as polymer flooding, which simply increase the oil recovery rate, but do not increase the ultimate amount of oil which can be recovered from the formation via conventional means, such as waterflooding. Typically, the percentage of incremental oil which can be recovered from the formation via the present process is preferably greater than about 10 percent of the original oil in place and preferably greater than about 15 percent of the original oil in place.

Although it is not certain, it is speculated that one mechanism for the process of the present invention is the ability of the injected gas to reduce the viscosity and density of the oil in place by swelling the oil despite the relative immiscibility of the gas in the oil. The injected water can subsequently sweep more oil to the production well because the oil is less viscous and less dense. Another possible beneficial mechanism for the present process is gas trapping. According to this mechanism, injected gas displaces water occupying pore spaces in the formation and the gas subsequently occupies the space. When the formation is then flooded with water, the gas in place diverts the water to oil-bearing portions of the formation which have not been previously flooded. Thus, the gas flood effectively reduces the volume of the formation which the waterflood must sweep to recover a given quantity of oil.

The process appears to contradict the conventional belief that an immiscible gas flood cannot substantially improve the mobility of a light oil. In general, the process of the present invention enables the recovery of oil which could not otherwise be recovered by waterflooding alone and, likewise, the process enables the recovery of more oil than a gas flood alone of infinite volume can recover.

The following example demonstrates the practice and utility of the present invention but is not to be construed as limiting the scope thereof.

EXAMPLE

A cylindrical core in its native state is prepared for a wateralternating-gas flood according to the present invention. The core is about 22 cm long and about 7.4 cm in diameter and has an average permeability of 36.4 md. The core has a mixed geology and comprises conglomerate.

The core is maintained at a pressure of about 26,200 kPa and a temperature of about 82° C. The core is saturated with a recombined oil resulting in an initial oil in place of 63.3 percent of the core's pore volume. The recombined oil has the following composition:

| Components | Material Balance (wt %) |
|---|---|
| Nitrogen | 0.83 |
| Carbon dioxide | 0.01 |
| Methane | 2.51 |
| Ethane | 1.07 |
| Propane | 2.21 |
| iso-Butane | 0.83 |
| n-Butane | 2.00 |

-continued

| Components | Material Balance (wt %) |
|---|---|
| iso-Pentane | 1.00 |
| n-Pentane | 1.25 |
| Hexanes | 3.40 |
| Heptanes-plus | 84.89 |

The recombined oil has an API specific gravity of about 60° API, a viscosity of 0.9 cp and a density of 0.74 g/cc at the aboverecited conditions.

Two flooding fluids are prepared for the water-alternating-gas flood. The water is a synthetic produced brine having the following composition:

| Component | Concentration (g/L) |
|---|---|
| NaCl | 17.88 |
| $Na_2SO_4$ | 0.32 |
| $CaCl_2$ | 9.80 |
| $MgCl_2.6H_2O$ | 0.45 |

The gas is a produced natural gas from a formation in proximity to the formation from where the core is obtained. The composition of the flooding gas is as follows:

| Component | Concentration (mole %) |
|---|---|
| Nitrogen | 1.26 |
| Carbon dioxide | 0.10 |
| Methane | 98.53 |
| Ethane | 0.11 |

The minimum miscibility pressure of the gas in the recombined oil is about 36,000 kPa and the bubble point pressure is about 12,800 kPa. The operating pressure of the present process noted above, 26,200 kPa, is between these levels.

The flood is performed by initially waterflooding the core to completion with the synthetic brine at a low flow rate (10 cc/hr) until no more oil is produced. The water injection rate is then increased to a high rate (100 cc/hr) and continued until oil production completely ceases again. This entire flooding stage is termed "Waterflood #1."

Thereafter, gas flooding is initiated at a low flow rate (10 cc/hr) until a substantial decrease in oil production is observed. Gas injection is then increased to a high flow rate and continues until oil production substantially decreases again. This entire flooding stage is termed "Gas Flood #1."

Thereafter, the core is sequentially waterflooded and gas flooded at a constant rate of 10 cc/hr until no further incremental oil is recovered. The flood is then terminated. The cumulative percentage of original oil in place (%OOIP) and the incremental %OOIP for each flooding stage are shown in the table below.

TABLE

Initial oil in place (% pore volume): 63.3

| Flooding Stage | Volume Injected (Pore volume) | Cumulative % OOIP | Incremental % OOIP |
|---|---|---|---|
| Waterflood #1 | 2.34 | 49.8 | — |
| Gas Flood #1 | 0.85 | 60.1 | 10.3 |
| Waterflood #2 | 1.49 | 64.7 | 4.6 |
| Gas Flood #2 | 0.80 | 67 | 2.3 |

TABLE-continued

| Flooding Stage | Volume Injected (Pore volume) | Cumulative % OOIP | Incremental % OOIP |
|---|---|---|---|
| | Initial oil in place (% pore volume): 63.3 | | |
| Waterflood #3 | — | 67 | 0.0 |

As the table indicates, the initial secondary waterflood (Waterflood #1) only recovers 49.8 percent of the original oil in place in the core. Additional stages of gas flooding followed by waterflooding recover an additional 17.2 percent of the incremental oil in place which could not have been recovered by only waterflooding.

While a foregoing preferred embodiment of the invention has been described and shown, it is understood that all alternatives and modifications, such as those suggested and others, may be made thereto and fall within the scope of the invention.

I claim:

1. An oil recovery process for recovering a low viscosity crude oil from an oil-bearing zone of a subterranean formation comprising:

(a) injecting a gas into said oil-bearing zone of said subterranean formation via an injection well in fluid communication with said oilbearing zone, said gas injected at an injection pressure substantially below the minimum miscibility pressure of said gas in said low-viscosity crude oil;

(b) displacing said low-viscosity crude oil away from said injection well toward an oil production well in fluid communication with said oil-bearing formation;

(c) continuously recovering said low-viscosity crude oil from said oil production well;

(d) thereafter terminating said injection of said gas upon substantial diminution of said continuous crude oil recovery from said production well;

(e) injecting water into said oil-bearing zone of said formation via said injection well;

(f) displacing said low-viscosity crude oil away from said injection well toward said oil production well;

(g) recovering said low-viscosity oil from said oil production well; and (h) terminating said water injection.

2. The process of claim 1 further comprising repeating steps (a) through (h) in sequence.

3. The process of claim 1 wherein the viscosity of said low viscosity crude oil is between about 0.5 and about 5 centipoise at formation conditions.

4. The process of claim 1 wherein the API gravity of said low viscosity crude oil is greater than about 40° API at formation conditions.

5. The process of claim 1 wherein said formation has been waterflooded to completion prior to injecting said gas and said process is a tertiary oil recovery process.

6. The process of claim 5 wherein the percentage of incremental oil recovery in steps (c) and (g) is greater than about 10 percent.

7. The process of claim 1 further comprising producing said gas from a subterranean formation prior to step a).

8. The process of claim 7 wherein said subterranean formation from which said gas is produced is a different formation than said formation containing said oil-bearing zone.

9. The process of claim 7 wherein said subterranean formation from which said gas is produced is the same formation as said formation containing said oil-bearing zone.

10. The process of claim 1 wherein said oil-bearing zone has an average permeability of between about 25 and about 1000 millidarcies.

11. The process of claim 1 wherein said oil-bearing zone contains two or more types of rock of differing permeability.

12. The process of claim 11 wherein said oil-bearing zone comprises a conglomerate.

13. The process of claim 1 wherein said injection pressure of said gas is substantially above the bubble point pressure of said low-viscosity crude oil.

14. The process of claim 1 wherein said water injection is terminated after substantial diminution of said crude oil recovery in step g) from said production well.

15. The process of claim 1 wherein said gas contacts said low viscosity crude oil in said oil-bearing zone of said subterranean formation, at a temperature and pressure sufficient to substantially swell and reduce the viscosity of said low-viscosity crude oil.

* * * * *